US005841113A

United States Patent [19]

Kim

[11] Patent Number: 5,841,113

[45] Date of Patent: Nov. 24, 1998

[54] UPWARD AND DOWNWARD MOVEMENT PREVENTION STRUCTURE FOR MICROWAVE OVEN

[75] Inventor: In Gwan Kim, Kyungsangnam-Do, Rep. of Korea

[73] Assignee: LG Electronics, Inc., Rep. of Korea

[21] Appl. No.: 867,492

[22] Filed: Jun. 2, 1997

[30] Foreign Application Priority Data

Jun. 3, 1996 [KR] Rep. of Korea ..... 1996/14748

[51] Int. Cl.[6] ..... H05B 6/76

[52] U.S. Cl. ..... 219/739; 219/756; 126/197

[58] Field of Search ..... 219/739, 724, 219/722, 723, 756; 126/197

[56] References Cited

U.S. PATENT DOCUMENTS 3,777,098 12/1973 Tapper et al. ..... 219/724
4,453,065 6/1984 Taylor, Jr. et al. ..... 219/739
4,497,993 2/1985 Aoyama ..... 219/724
4,814,571 3/1989 Bowen et al. ..... 219/739

*Primary Examiner*—Philip H. Leung
*Attorney, Agent, or Firm*—Ostrolenk, Faber, Gerb & Soffen, LLP

[57] ABSTRACT

An upward and downward movement prevention structure for a microwave oven which is capable of more effectively preventing an upward and downward movement of a door panel when moving the microwave oven by forming movement prevention protrusions and movement prevention protrusion insertion grooves in the side surface of the door panel and a portion of the control panel which portion is matched with the side surface of the door panel in which the movement prevention protrusions are formed. The structure includes a main frame, a door panel disposed in a front surface of the main frame, a control panel disposed beside the door panel, at least more than one movement prevention protrusion means formed in one side surface of the door panel, and at least more than one movement prevention protrusion insertion groove means formed in one side surface of the control panel, said side surface of the control panel being matched with the side surface of the door panel.

5 Claims, 3 Drawing Sheets

UPWARD AND DOWNWARD MOVEMENT PREVENTION STRUCTURE FOR MICROWAVE OVEN

BACKGROUND OF THE INVENTION

1. Field of the Invention

The present invention relates to an upward and downward movement prevention structure for a microwave oven, and in particular to an improved upward and downward movement prevention structure for a microwave oven which is capable of preventing an upward and downward movement of a door panel by forming movement prevention protrusions and movement prevention protrusion insertion grooves in the side surfaces of the door panel and control panel, respectively.

2. Description of the Conventional Art

FIG. 1 illustrates a conventional microwave oven.

As shown therein, a main body 1 includes a door panel 3 disposed in a front surface of the main body 1 and having a see-through window 2, and a control panel 4 disposed beside the door panel 3 in which control panel 4 a plurality of operation switches (not shown) are disposed.

However, when moving the above-described conventional microwave oven, the door panel 3 may be upwardly and downwardly moved for thus deforming the door panel 3, thereby causing an inaccurate engagement between the main body 1 and the door panel 3.

In addition, in order to prevent the above-described problems, since a filament tape 4 is additionally attached to the door panel 3 and the main body 1, respectively, the product fabrication process is increased, and the fabrication cost is increased thereby.

SUMMARY OF THE INVENTION

Accordingly, it is an object of the present invention to provide an upward and downward movement prevention structure for a microwave oven which overcomes the aforementioned problem encountered in the conventional art.

It is another object of the present invention to provide an improved upward and downward movement prevention structure for a microwave oven which is capable of more effectively preventing an upward and downward movement of a door panel when moving the microwave oven by forming movement prevention protrusions and movement prevention protrusion insertion grooves in the side surface of the door panel and a portion of the control panel which portion is matched with the side surface of the door panel in which the movement prevention protrusions are formed.

To achieve the above objects, there is provided an upward and downward movement prevention structure for a microwave oven which includes a main frame, a door panel disposed in a front surface of the main frame, a control panel disposed beside the door panel, at least more than one movement prevention protrusion formed in one side surface of the door panel, and at least more than one movement prevention protrusion insertion groove formed in one side surface of the control panel, said side surface of the control panel being matched with the side surface of the door panel.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The structure of an upward and downward movement prevention structure for a microwave oven according to the present invention will now be explained.

Figure 1:
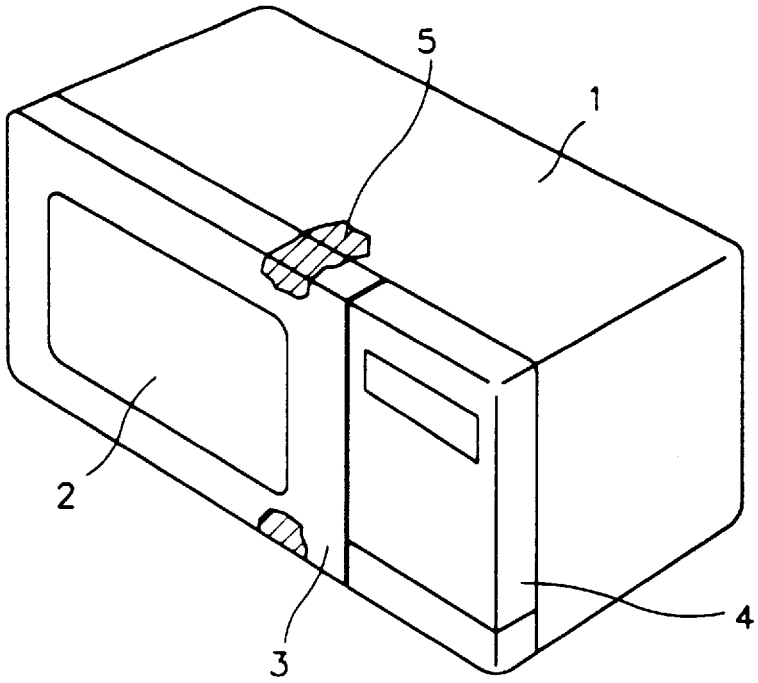
FIG. 1 CONVENTIONAL ART
FIG. 1 is a perspective view illustrating a conventional microwave oven.
Figure 2:
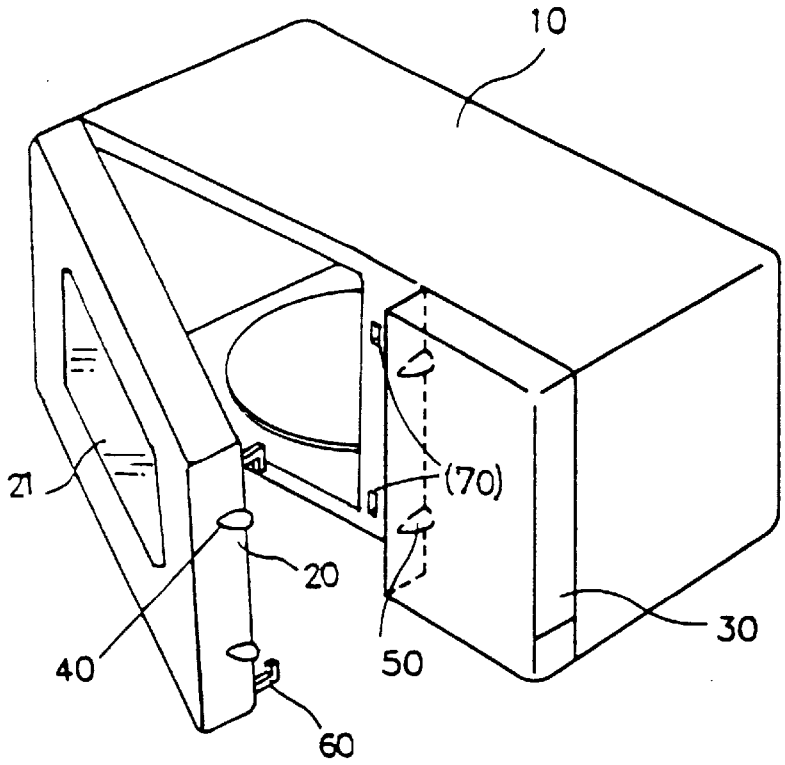
FIG. 2 is a perspective view illustrating a microwave oven with an upward and downward movement prevention structure according to a first embodiment of the present invention.

FIG. 2 illustrates a microwave oven with an upward and downward movement prevention structure according to a first embodiment of the present invention.

As shown therein, a main body 10 includes a door panel 20 disposed in a front surface of the main body 10 and having a see-through window 21, and a control panel 30 disposed beside the door panel 20 in which control panel 30 a plurality of operation switches (not shown) are disposed.

In particular, movement prevention protrusions 40 are formed in a side surface of the door panel 20, and movement prevention protrusion insertion grooves 50 are formed in a side surface of the door panel 20, so that the movement prevention protrusions 40 are inserted into the movement prevention protrusion insertion grooves 50, respectively, when the door panel 20 is closed, whereby it is possible to prevent an upward and downward movement of the door panel 20.

Figure 3:
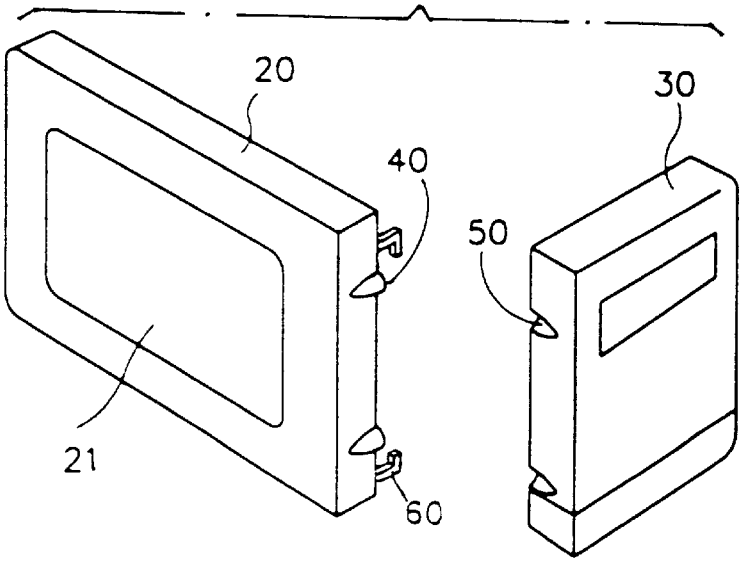
FIG. 3 is a perspective view illustrating an upward and downward movement prevention structure for a microwave oven according to the present invention.

FIG. 3 illustrates an upward and downward movement prevention structure for a microwave oven according to the present invention.

As shown therein, two movement prevention protrusions 40 are formed in a side surface of the door panel 20, and two movement prevention protrusion insertion grooves 50 are formed in a side surface of the control panel which side surface is matched with the side surface of the door panel 20, so that the movement prevention protrusions 40 are inserted into the movement prevention protrusion insertion grooves 50 when the door panel 20 is closed.

Figure 4:
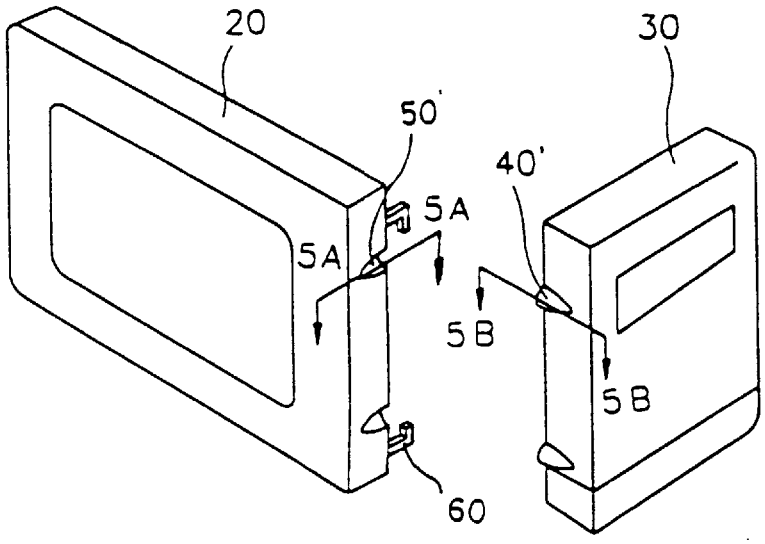
FIG. 4 is a perspective view illustrating an upward and downward movement prevention structure for a microwave oven according to a second embodiment of the present invention.

FIG. 4 illustrates an upward and downward movement prevention structure for a microwave oven according to a second embodiment of the present invention.

As shown therein, two movement prevention protrusions 40' are formed in a side surface of the control panel 30, and movement prevention protrusion insertion grooves 50' are formed in a side surface of the door panel 20 which side surface is matched with the side surface of the control panel 30. In more detail, the formation positions of the movement prevention protrusion 40' and the movement prevention protrusion insertion grooves 50' are changed unlike the formation positions of the movement prevention protrusions 40 and the movement prevention protrusion insertion grooves 50.

Figure 5A:
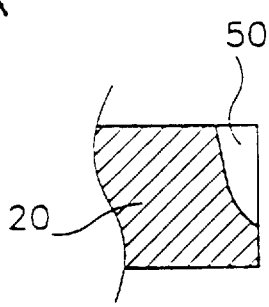
FIG. 5 is cross-sectional views taken along lines A-A' and B-B' of FIG. 4 according to the present invention.
Figure 5B:
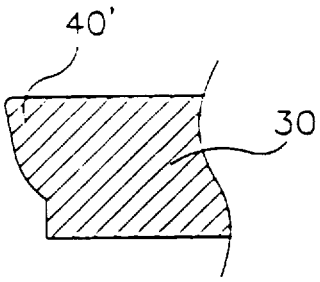

FIG. 5 is cross-sectional views taken along lines A-A' and B-B' of FIG. 4 according to the present invention.

As shown therein, the movement prevention protrusion insertion grooves 50' is formed to be deeper toward the inward direction of the same, and the movement prevention protrusions 40' are formed to be higher toward the inward direction of the same. Reference numeral 60 denotes latch pawls provided in a conventional microwave oven and 70 denotes an opening into which the latch pawls are inserted.

The operation and effects of the upward a downward movement prevention structure for a microwave oven according to the present invention will now be explained with reference to the accompanying drawings.

First, when the door panel 20 is closed, the movement prevention protrusions 40 formed in a side surface of the door panel 20 are inserted into the movement prevention protrusion insertion grooves 50 formed in a side surface of the control panel 30. Since the movement prevention protrusions 40 are tightly inserted into the movement prevention insertion grooves 50, the door panel 20 is not upwardly and downwardly moved when moving the microwave oven. As is clearly seen in the Figures, the aforementioned movement preventing protrusions and cooperating grooves are pre-fixed on the relevant surfaces of the door panel and the control panel. Since these protrusions and grooves are pre-fixed, i.e. pre-formed during the original manufacture of the door panel and the control panel during assembly of the device, the operator can set the proper alignment of the door without any need to observe or measure or judge the alignment of the door.

As described above, the upward and downward movement prevention structure for a microwave oven according to the present invention is capable of preventing an upward and downward movement of the door panel by forming movement prevention protrusions and movement prevention protrusion insertion grooves in the side surfaces of the door panel and control panel, respectively, whereby it is possible to prevent upward and downward movements of the door panel when moving the microwave oven, thereby preventing deformation of the door panel.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. A microwave oven having a main frame, a door panel disposed on a front surface of the main frame, a control panel disposed on one side of the door panel, and a door latch assembly formed to include the door panel and the main frame, and further including, at least one microwave oven door upward and downward movement preventing structure which comprises a first part that is immovably formed on one side surface of the door panel and a second part immovably formed on one side of the control panel corresponding to said one side surface of the door panel and cooperating with the first part to prevent upward and downward movements of the door panel, said movement preventing structure lacking the means to latch the door panel to the control panel.

2. The microwave oven of claim 1, wherein said microwave oven door upward and downward movement prevention structure includes:

at least one movement preventing protrusion immovably formed on one side surface of the door panel and at least one movement preventing protrusion insertion groove immovably formed on one side surface of the control panel for receiving the movement preventing protrusion, said movement preventing protrusion being aligned with the movement preventing groove of the door panel.

3. The microwave oven of claim 2, wherein said at least one movement preventing protrusion comprises a pair of protrusions, and wherein said at least one movement preventing protrusion insertion groove comprises a pair of grooves.

4. The microwave oven of claim 3, in which the movement preventing insertions grooves are formed to be deeper towards an inward direction of the grooves and the movement preventing protrusions are formed to protrude to a higher degree toward an inward direction of the protrusions.

5. The microwave oven of claim 1, wherein said microwave oven door upward and downward movement prevention structure includes:

at least one movement preventing protrusion immovably formed on one side surface of the control panel and at least one movement preventing insertion groove immovably formed on one side surface of the door panel for receiving the movement preventing protrusion, said movement prevention groove being aligned with the movement preventing protrusion of the control panel.

* * * * *